US005931314A

United States Patent [19]

Jackstat et al.

[11] Patent Number: 5,931,314

[45] Date of Patent: Aug. 3, 1999

[54] CLAW SHOE HANGER

[75] Inventors: Wilfried H. Jackstat, East Windsor; Charlie Anderson, Ridgewood, both of N.J.

[73] Assignee: Footstar Corporation, Mahwah, N.J.

[21] Appl. No.: 08/938,287

[22] Filed: Sep. 26, 1997

[51] Int. Cl.[6] ..... A47F 7/08

[52] U.S. Cl. ..... 211/34; 211/113; D6/411

[58] Field of Search ..... 211/34, 85.3, 113, 211/35; 223/85; 248/215

[56] References Cited

U.S. PATENT DOCUMENTS

| | | | |
|---|---|---|---|
| D. 143,795 | 2/1946 | Case . | |
| D. 165,942 | 2/1952 | Stein . | |
| D. 169,429 | 4/1953 | Enrich . | |
| D. 190,352 | 5/1961 | Hackathorn . | |
| 275,581 | 4/1883 | Bundy . | |
| D. 329,951 | 10/1992 | Walter . | |
| D. 330,122 | 10/1992 | Walter . | |
| 505,655 | 9/1893 | Hammerstein | 211/34 |
| 600,599 | 3/1898 | Slattery . | |
| 1,310,281 | 7/1919 | Clark | 211/34 |
| 1,361,056 | 12/1920 | Hickman . | |
| 1,364,161 | 1/1921 | Uecker . | |
| 1,501,807 | 7/1924 | Petschel . | |
| 1,567,037 | 12/1925 | Cavanna . | |
| 1,567,038 | 12/1925 | Cavanna . | |
| 1,568,330 | 1/1926 | Harding . | |
| 1,626,399 | 4/1927 | Fischer . | |
| 1,820,492 | 8/1931 | Rattazzi . | |
| 1,899,813 | 2/1933 | Lester . | |
| 2,095,900 | 10/1937 | Albert . | |
| 2,107,306 | 2/1938 | Pollinger . | |
| 2,205,817 | 6/1940 | Kramb . | |
| 2,262,459 | 11/1941 | Hoppe . | |
| 2,608,306 | 8/1952 | Mills . | |
| 2,623,582 | 12/1952 | Handley . | |
| 2,623,583 | 12/1952 | Handley . | |
| 2,860,788 | 11/1958 | Hardman . | |
| 2,965,237 | 12/1960 | Wells | 211/35 |
| 2,994,462 | 8/1961 | Hirsch et al. . | |
| 3,063,550 | 11/1962 | Boden et al. . | |
| 3,104,013 | 9/1963 | Fisk . | |
| 3,123,850 | 3/1964 | Piken . | |
| 3,292,794 | 12/1966 | Lowe | 211/34 |
| 3,539,052 | 11/1970 | Bellock . | |
| 3,563,390 | 2/1971 | Kim . | |
| 3,918,670 | 11/1975 | Doherty . | |
| 4,453,655 | 6/1984 | Smilow et al. | 211/113 X |
| 4,542,838 | 9/1985 | Perez-Tubens et al. . | |
| 4,760,912 | 8/1988 | Vaida | 211/113 X |
| 4,765,467 | 8/1988 | Kolton et al. | 211/113 X |
| 4,805,816 | 2/1989 | Freund . | |
| 4,823,962 | 4/1989 | Arias | 211/34 |
| 4,915,238 | 4/1990 | Cassel . | |
| 4,917,278 | 4/1990 | Ventimiglia . | |

(List continued on next page.)

FOREIGN PATENT DOCUMENTS

| | | | |
|---|---|---|---|
| 2696892 | 7/1992 | France | 211/113 |
| 2103081 | 2/1983 | United Kingdom . | |

*Primary Examiner*—Daniel P. Stodola
*Assistant Examiner*—Khoa Tran

[57] ABSTRACT

A shoe hanger, for displaying a pair of shoes and prominently indicating information regarding same in retail stores, includes a central elongated body, a hook, two shoe support elements and a label support area. The central elongated body terminates at its upper end with said hook and at its lower end with two shoe support elements onto which a pair of shoes is fitted. Each shoe support element includes an inverted U-shaped lateral support portion which extends upwardly from, parallel to, and in the same plane as, the central elongated member, terminating at a point at or near the upper end of said central elongated member. The lateral support portion supports the shape of the sides of the vamps of the shoes fitted thereon. A semicircular transverse support portion extends from the bight of the inverted U and lies in a plane perpendicular to the plane of the lateral support portion and supports the tops of the vamps of the shoes fitted thereon. The label support area, which lies in the same plane as the central elongated body and hook, is integral with and located directly above the hook.

9 Claims, 1 Drawing Sheet

U.S. PATENT DOCUMENTS 4,978,043 12/1990 Uke ..... 211/113 X
5,065,871 11/1991 Chan .
5,114,017 5/1992 Doyel .
5,127,528 7/1992 Cone .
5,209,382 5/1993 Chang .
5,236,109 8/1993 Zuckerman .
5,282,553 2/1994 Ibled ..... 223/85
5,423,435 6/1995 Pollard et al. .
5,480,073 1/1996 LaManna .
5,511,756 4/1996 Spradling .
5,566,838 10/1996 Tseng .

CLAW SHOE HANGER

BACKGROUND OF THE INVENTION

This invention relates generally to a device for displaying footwear, and, more specifically, to such a device which suspends and supports a pair of shoes, and indicates the trademark, style, size, price and/or other information, for display in retail stores.

Shoe hangers used for display purposes are generally known in the prior art. U.S. Pat. No. 4,823,962, issued on Apr. 25, 1989 to Arias, discloses a shoe display and storage hanger which is used to display shoes in retail stores. The shoe hanger comprises a vertical, elongated, flat central member, which terminates at its upper end with a hook for suspension of the device, and at its lower end with a U-shaped member, which includes two tongue members extending upwardly and onto which the shoes are fitted. Information regarding the shoes, including the style, price and/or other characteristics, may be indicated on a label support area along the central portion of the vertical, elongated, flat central member. A tab above the hook may indicate the size of the shoe. Importantly, the tongue members are planar and do not conform to the shape of the shoes fitted thereon.

U.S. Pat. No. 5,282,553, issued on Feb. 1, 1994 to Ibled, discloses a shoe holder which is also used to display shoes in retail stores, especially supermarkets. The shoe holder comprises a vertical central rod, which terminates at its upper end with a hook for suspension of the device, and at its lower end with a label support area and two support elements onto which the shoes are fitted. The label support area, which is located at the bottom of the device, can be used to indicate the style, price and/or other characteristics of the shoes. The support elements include planar loops and do not conform to the shape of the shoes displayed thereon.

One problem associated with the shoe hangers taught by Arias and Ibled is that the label support areas are located near the middle or bottom of the devices, respectively, such that information regarding the trademark, style, price and/or other information about the shoes cannot be prominently displayed.

Another problem associated with the shoe hangers disclosed in Arias and Ibled is that the support elements onto which the shoes are fitted are generally planar, and do not firmly and immovably support the shoes and maintain the shape of the vamps of the shoes displayed thereon.

SUMMARY OF THE INVENTION

It is, therefore, an important object of the invention to provide a shoe hanger which suspends a pair of shoes for display purposes and firmly supports and maintains the shape of the shoes fitted thereon.

It is another object of the invention to provide a shoe hanger which suspends a pair of shoes for display purposes on which the trademark, style, price and/or other relevant information can be prominently indicated.

In summary, there is provided a shoe hanger, which is constructed of plastic, and may be used to suspend and support a pair of shoes for display purposes. The shoe hanger comprises a central body, which terminates at its upper end with a hook for suspension of the device and at its lower end with two support elements. The support elements are three-dimensional and fit snugly inside and support the shape of the shoe. The support elements extend upwardly such that each shoe fitted thereon is suspended vertically with its toe pointed upwardly, and the top of its vamp pointed outwardly toward the consumer. The trademark, style, price, size and/or other characteristics of the shoes may be prominently indicated on a rectangular display area located above, and integral with, the hook of the device.

Further objects, features and advantages of the invention will become evident from a consideration of the following detailed description when taken in conjunction with the accompanying drawings and appended claims.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction, and operation, and many of its advantages should be readily understood and appreciated.

DETAILED DESCRIPTION OF THE PREFERRED EMBODIMENT

Figure 1:
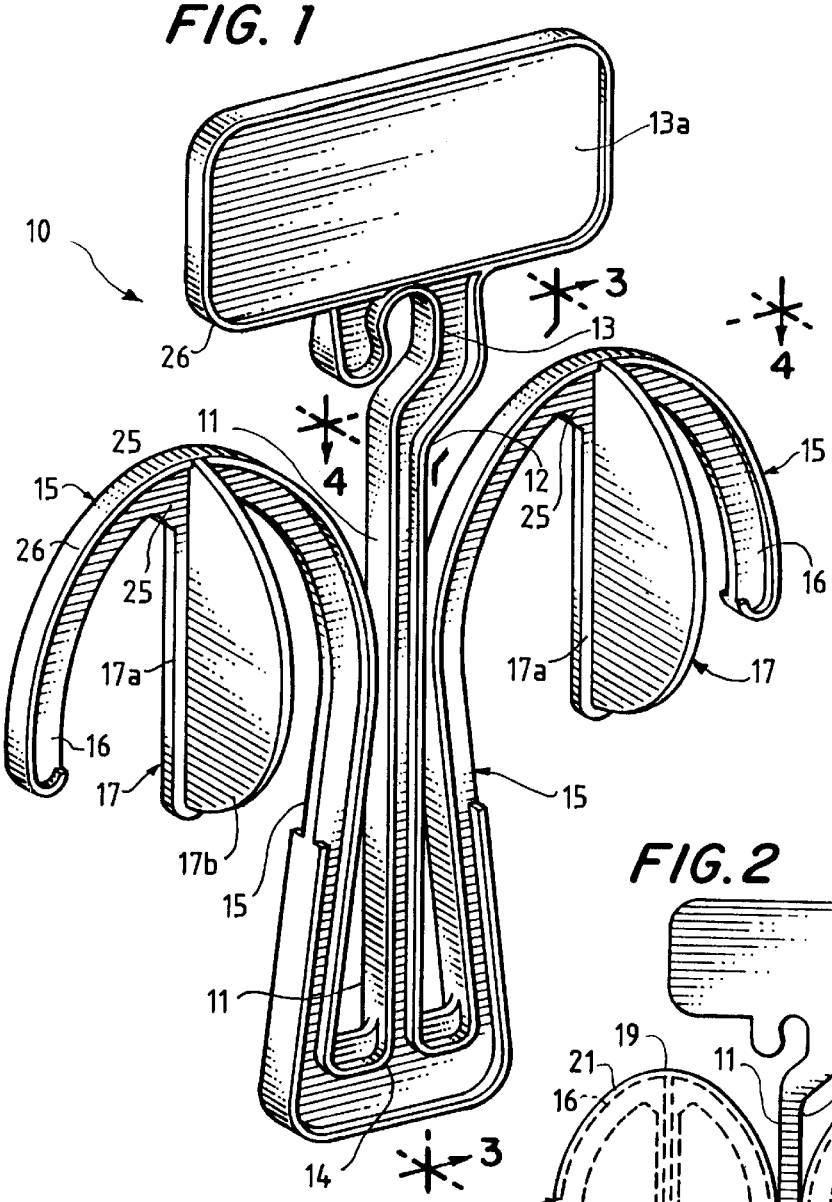
FIG. 1 is a perspective view of a shoe holder in accordance with the preferred embodiment of the invention.

Turning now to FIGS. 1 through 4, there is depicted a shoe hanger (10) in accordance with a preferred embodiment of the invention. The shoe hanger (10) includes a central, elongated base member (11), a hook (13), two shoe support elements (15) and a label support area **(13*a*). The entire hanger (10)** is preferably of unitary, one-piece construction, being made of a rigid material, preferably a suitable plastic.

Figure 3:
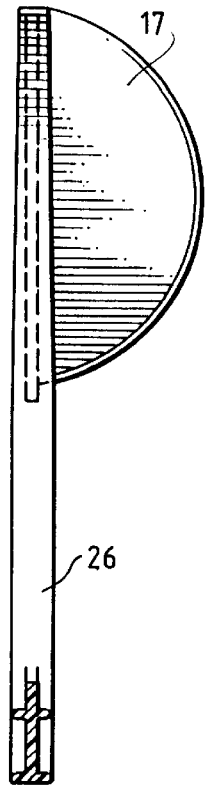
FIG. 3 is a vertical sectional view, taken along line 3—3 in FIG. 1.

As shown in FIGS. 1 and 3, base member (11) is oriented vertically in use and terminates at its upper end (12) with hook (13), and at its lower end (14) with shoe support elements (15). The hook (13) allows the hanger (11) to be suspended from a peg on a display board, a lateral support rail or any other suitable lateral support means (not shown).

Label support area **(13*a*), located directly above hook (13), is a substantially flat, rectangular area in which trademark, style, price, size and/or other relevant information about the shoes fitted on the hanger (10)** may be indicated.

Each support element (15) includes a first lateral support portion (16) and a second transverse support portion (17). Each lateral support portion (16) is generally inverted U-shaped. Each transverse support portion (17) includes an elongated, flat arm **(17*a*), depending from the bight of the corresponding inverted U-shaped portion (16), and a generally semicircularly shaped flat vane (17*b*) which lies in a plane perpendicular to the plane of the lateral support portion (16). Each lateral support portion (16) extends upwardly substantially coplanar with base (11) to a maximum height at or near the upper end (12) of base (11)**.

All of the base member (11), the hook (13), the label area **(13*a*) and the lateral support elements (16) and arms (17*a*) are continuous with one another and define portions of a common, flat, planar web (25), integral along substantially its entire periphery with a peripheral flange (26)**, which extends substantially perpendicular to the plane of the web

(25) substantially equidistantly from the opposite sides thereof. More particularly, the peripheral flange (26) extends along the entire perimeter of the web (25) except for the arms (17*a*) and the undersides of the inverted U-shaped portions of the lateral support portions (16) of the shoe support elements (15). The flange (26) serves to rigidify the structure. It is significant that, because of the common web (25), the web portions of the base member (11), hook (13), label area (13*a*) and shoe support elements (15) are all coplanar.

Figure 2:
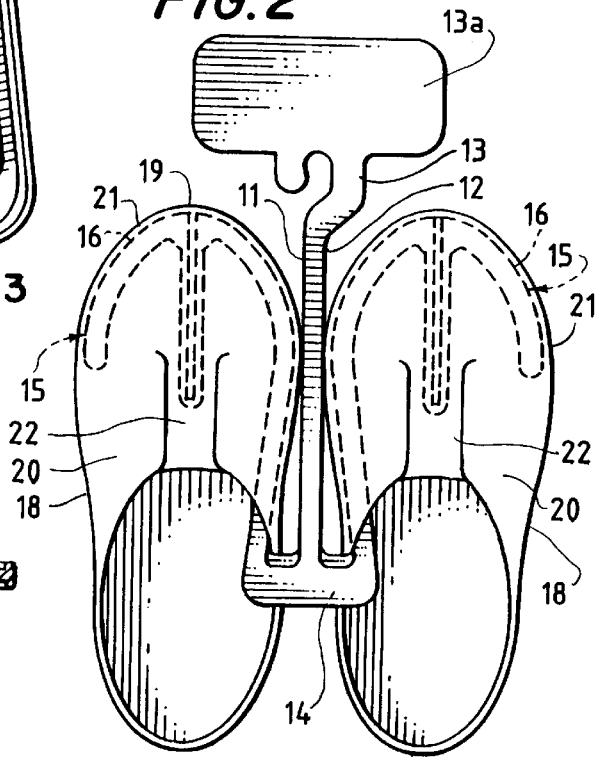
FIG. 2 is a reduced, front elevation view of the shoe hanger of FIG. 1 with a pair of shoes fitted thereon to show the shoe hanger in use.
Figure 4:
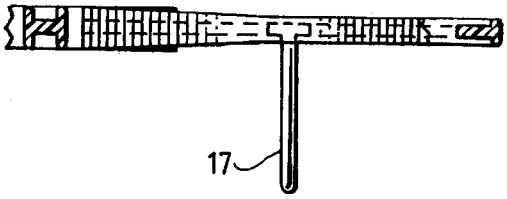
FIG. 4 is a fragmentary horizontal sectional view taken along line 4—4 in FIG. 1.

Turning now to FIG. 2, a pair of shoes (18) are positioned on support elements (15), suspended vertically with toes (19) pointed upward and tops (22) of vamps (20) facing outward. Support elements (15) are inserted into the shoes (18) and slide forward toward toes (19) of shoes (18) until they cannot slide forward any further. As can best be seen in FIG. 2, lateral support portions (16) support the shape of the sides (21) of vamps (20) of the shoes (18). As can best be seen in FIGS. 3 and 4, transverse support portions (17) support the shape of the tops (22) of vamps (20) of the shoes (18). Thus, support elements (15) are the functional equivalent of shaped shoe trees.

The trademark, style, price, size and/or other characteristics about the shoes (18) may be indicated at label support area (13*a*), which is located at the top of the hanger (10) and serves to prominently display information about the shoes (18) to the consumer.

Hook (13) allows the device to be suspended from a peg on a display board, a lateral support rail or any other suitable lateral support means.

Preferably, each of the lateral support portions (16) of the shoe support elements (15) extends from a lateral extremity the lower end (14) of the base member (11) and then slopes upwardly and inwardly toward the upper end of the base member (11) for cooperation therewith to form resilient clips to resiliently grip the adjacent portions of supported shoes therebetween.

When a consumer desires to more closely examine, or try on, a particular pair of shoes, he or she may remove the shoe hanger (10), and the shoes (18) fitted thereon, from the display board or lateral support rail by grasping the shoe hanger (10) at or near the hook (13) or label support area (13*a*). Once the hanger (10) is removed from the display board, the shoes (18) may be easily removed from the hanger (10) by fixing the hanger (10) and sliding the shoes (18) upward with respect to the hanger (10) such that the support elements (15) slide out of the shoes (18). The empty hanger (10) may then be returned to the display board or placed in a bin to be recirculated at a later time.

The invention has been described in an illustrative manner, and it is to be understood that terminology which has been used is intended to be in the nature of description rather than that of limitation. Obviously, many modifications and variations of the present invention are possible in light of the above teachings. It is, therefore, to be understood that within the scope of the claims, the invention may be practiced otherwise than as specifically described.

What is claimed is:

1. A shoe hanger for displaying a pair of shoes comprising:

a central elongated base member;

a hook;

two shoe support elements; and a label support area;

wherein said central elongated base member, hook and label support area have flat planar portions which lie in the same plane;

said central elongated base member terminating at its upper end with said hook, and at its lower end with said support elements;

said label support area being integral with and located directly above said hook;

said support elements each comprising a first support portion and a thin flat second support portion;

said first support portion extending upwardly parallel to said plane and terminating at a point at or near said upper end of said elongated base member;

said first support portion including an inverted U-shaped portion including two side leg portions joined by a bight portion, and a central leg integral with said bight portion and projecting therefrom between said side leg portions and spaced from each;

said second support portion extending outwardly from said central leg substantially perpendicular to said plane.

2. A shoe hanger for displaying a pair of shoes comprising:

a central elongated base member including a hook, and at least one shoe-engaging member carried by said base member and adapted to be received in an associated shoe, said shoe-engaging member having a first elongated flat curved portion lying in a first plane and including an inverted U-shaped portion including two side leg portions joined by a bight portion, and a central leg integral with said bight portion and projecting therefrom between said side leg portions and spaced from each; and a second thin flat curved portion integral with said central leg and lying in a second plane substantially perpendicular to said first plane.

3. The shoe hanger of claim 2, said shoe hanger including two shoe-engaging members.

4. The shoe hanger of claim 3, said shoe hanger including coplanar first portions.

5. The shoe hanger of claim 3, wherein said two shoe-engaging members are respectively disposed on opposite sides of said base member.

6. The shoe hanger of claim 2, said shoe hanger including an inverted U-shaped first portion and a semicircular-shaped second portion.

7. The shoe hanger of claim 2, said shoe hanger being of unitary, one-piece construction.

8. The shoe hanger of claim 2, wherein said hook is disposed at one end of said base member and said shoe-engaging member at the other end of said base member.

9. The shoe hanger of claim 8, and further comprising a label support area.

* * * * *